US010443534B2

(12) United States Patent
Graf et al.

(10) Patent No.: US 10,443,534 B2
(45) Date of Patent: Oct. 15, 2019

(54) METHOD AND DEVICE FOR OPERATING A FUEL PUMP

(71) Applicant: Continental Automotive GmbH, Hannover (DE)

(72) Inventors: Rolf Graf, Glashuetten (DE); Sebastian Koerner, Schoengeising (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/028,913

(22) PCT Filed: Oct. 13, 2014

(86) PCT No.: PCT/EP2014/071849
§ 371 (c)(1),
(2) Date: Apr. 12, 2016

(87) PCT Pub. No.: WO2015/055559
PCT Pub. Date: Apr. 23, 2015

(65) Prior Publication Data

US 2016/0252032 A1 Sep. 1, 2016

(30) Foreign Application Priority Data

Oct. 14, 2013 (DE) ..... 10 2013 220 697

(51) Int. Cl.
*F02D 41/30* (2006.01)
*F02D 41/06* (2006.01)
(Continued)

(52) U.S. Cl.
CPC ..... *F02D 41/3082* (2013.01); *F02D 41/064* (2013.01); *F02D 41/065* (2013.01); *F04B 49/02* (2013.01); *F04B 49/065* (2013.01)

(58) Field of Classification Search
CPC ... F02D 41/064; F02D 41/3082; F02D 41/065
(Continued)

(56) References Cited

U.S. PATENT DOCUMENTS 1,682,331 A * 8/1928 Goyne et al. ..... F04D 9/041 417/12
3,573,482 A * 4/1971 Brooks ..... F02M 37/08 123/179.16

(Continued)

FOREIGN PATENT DOCUMENTS

DE 102010026953 A1 * 1/2012 ..... F02M 37/06
DE 102010026953 A1 * 1/2012 ..... F02M 37/08

(Continued)

*Primary Examiner* — Sizo B Vilakazi
*Assistant Examiner* — Brian R Kirby
(74) *Attorney, Agent, or Firm* — Cozen O'Connor

(57) ABSTRACT

A fuel pump of a motor vehicle includes: a pump stage configured to induce fuel from a fuel tank; an electric motor configured to drive the pump stage; and control electronics configured to supply the electric motor with electrical current. The control electronics includes a memory storing a low temperature start program and a standard start program. The control electronics are connected to a temperature sensor and a selector configured to select the start program depending on the sensed temperature.

8 Claims, 1 Drawing Sheet

(51) Int. Cl.
*F04B 49/06* (2006.01)
*F04B 49/02* (2006.01)

(58) Field of Classification Search
USPC ..... 417/14
See application file for complete search history.

(56) References Cited

U.S. PATENT DOCUMENTS 4,508,077 A * 4/1985 Shimbara ..... F02D 41/3082 123/357
4,528,963 A * 7/1985 Bessho ..... F02D 41/065 123/179.7
5,159,808 A * 11/1992 Kast ..... F02C 7/236 60/39.091
5,237,975 A * 8/1993 Betki ..... F02D 41/3082 123/456
5,291,578 A * 3/1994 Kalami ..... F02D 41/22 123/497
5,542,395 A * 8/1996 Tuckey ..... F02D 41/3082 123/381
5,711,275 A * 1/1998 Minagawa ..... F02D 41/3082 123/179.17
5,893,352 A * 4/1999 Fujiwara ..... F02D 41/061 123/359
6,161,423 A * 12/2000 Okuma ..... F02M 25/0818 123/520
6,674,260 B1 * 1/2004 Harriman ..... H02P 7/29 318/560
6,892,705 B2 * 5/2005 Grau ..... F02D 35/025 123/456
7,281,520 B2 * 10/2007 Klenk ..... F02M 37/04 123/446
7,448,363 B1 * 11/2008 Rasmussen ..... F02D 41/062 123/179.17
8,046,126 B2 * 10/2011 Yanagida ..... B60K 6/365 165/200
8,061,329 B2 11/2011 Pursifull et al.
8,650,003 B2 * 2/2014 Regnard De Lagny ..... G06F 11/273 123/479
2003/0116490 A1 * 6/2003 Keyster ..... B01D 35/18 210/184
2004/0011333 A1 1/2004 Grau
2006/0231079 A1 * 10/2006 Paluszewski ..... F02M 37/025 123/514
2007/0286747 A1 * 12/2007 Nagase ..... F02D 41/065 417/410.1
2008/0003114 A1 * 1/2008 Levin ..... F04B 49/002 417/306
2008/0245343 A1 * 10/2008 Graf ..... F02D 41/3082 123/497
2009/0107442 A1 * 4/2009 Ma ..... F02M 39/02 123/179.17
2009/0114191 A1 * 5/2009 Pursifull ..... F02D 41/2496 123/447
2009/0178803 A1 * 7/2009 Neuroth ..... E21B 36/04 166/250.01
2011/0023833 A1 * 2/2011 Chamarthi ..... F02D 41/3845 123/464
2011/0056226 A1 * 3/2011 Okubo ..... F04C 28/06 62/208
2011/0077875 A1 * 3/2011 Tran ..... E03F 5/22 702/45
2011/0130979 A1 * 6/2011 Kumagai ..... F02D 19/0605 702/50
2011/0162622 A1 * 7/2011 Kojima ..... F02D 41/062 123/457
2011/0231083 A1 * 9/2011 Saruwatari ..... F02D 41/22 701/107
2012/0063920 A1 * 3/2012 Ikeda ..... F16H 61/0021 417/32
2012/0143478 A1 * 6/2012 Kim ..... F02D 33/006 701/104
2012/0148419 A1 * 6/2012 Aspen ..... F04B 49/065 417/53
2012/0318237 A1 * 12/2012 Tsukagoshi ..... F02D 41/0025 123/445
2013/0120944 A1 * 5/2013 Graf ..... F02M 37/08 361/752
2013/0138325 A1 * 5/2013 Lee ..... F01N 3/0231 701/103
2013/0218441 A1 * 8/2013 Thomas ..... F02D 41/065 701/105
2013/0313048 A1 * 11/2013 Naqvi ..... F16H 61/12 184/6
2014/0121936 A1 * 5/2014 Fulton ..... F02D 41/064 701/101

FOREIGN PATENT DOCUMENTS

DE 102011077237 A1 * 12/2012 ..... G01K 7/16
JP 09-068122 3/1997
JP 2003-429899 5/2003
JP 2003129899 A * 5/2003 ..... Y02T 10/123
JP 2004-19612 1/2004
JP 2004-509280 3/2004
JP 2005009398 A * 1/2005 ..... F02M 63/0205
JP 2009-115087 5/2009
JP 2009243286 A * 10/2009
JP 48-40531 12/2011
WO WO 02/25089 A1 3/2002
WO WO 03/012274 A1 2/2003
WO WO 2010/134150 11/2010

* cited by examiner

METHOD AND DEVICE FOR OPERATING A FUEL PUMP

CROSS-REFERENCE TO RELATED APPLICATIONS

This is a U.S. national stage of application No. PCT/EP2014/071849, filed on 13 Oct. 2014, which claims priority to the German Application No. 10 2013 220 697.6 filed 14 Oct. 2013, the content of both incorporated herein by reference.

BACKGROUND OF THE INVENTION

1. Field of the Invention

The invention concerns a fuel pump of a motor vehicle, in particular for diesel fuel with a pump stage provided for the induction of fuel from a fuel tank, with an electric motor for driving the pump stage and with control electronics for supplying the electric motor with electrical current. Furthermore, the invention concerns a method for operating a fuel pump of a motor vehicle, in particular for diesel fuel, with which control electronics supply an electric motor with electrical current and the electric motor drives a pump stage that sucks fuel from a fuel tank.

2. Related Art

With fuel pumps known from practice for diesel fuels, the pump stage is in the form of a displacement pump. An electrically commutated motor is mainly used as an electric motor. Such displacement pumps can, for example, be so-called G-rotor pumps, screw pumps or roller cell pumps. With these, in principle both the electric motors used and also the pump stages used have torque or load fluctuations with the angle of rotation. In order to ensure a reliable start of the internal combustion engine supplied by the fuel pump, with today's fuel pumps a pressure rise from zero to 4 to 6 bar is required in the start-up phase within 100 ms to 300 ms. Methods for operating such fuel pumps are generally designed to comply with emission values during the rapid pressure rise. Taking the viscosity of the fuel into account is not provided.

However, diesel fuel has the property that below a certain temperature paraffins are excreted as flakes. This results in increasing viscosity of the fuel with reducing temperature. Above a certain viscosity, the envisaged start-up of the fuel pump is therefore hindered, which results in a false start of the internal combustion engine supplied by the fuel pump.

SUMMARY OF THE INVENTION

An object of the invention is to solve the problem of continuing to operate a fuel pump of the aforementioned type so that it ensures an adequate supply of fuel to the internal combustion engine even at low temperatures. Furthermore, a method for starting the fuel pump is to be provided that ensures an adequate supply of fuel even at low temperatures.

The first problem is solved according to an aspect of the invention by the control electronics comprising a memory for a low temperature start program and a standard start program and being connected to a temperature sensor and comprising selection structure configured to select the start program depending on the temperature.

The control electronics comprise various programs with which the fuel pump can be started depending on the temperature of the fuel. Therefore, at low temperatures the start program can be aimed at a particularly reliable start-up behavior. At sufficiently high temperatures, the start program can be optimized for the lower viscosity values of the fuel.

The structural complexity for detecting the temperature of the fuel pump can be kept particularly low according to an advantageous development of the invention if a temperature sensing system provided in the control electronics is in the form of a temperature sensor. With the design the temperature sensing system that is generally present in the electronic components in any case can be used, so that the fitting of further components is avoided. The pump temperature can be concluded from the values of the temperature sensing system.

Allowances are to be made for temperature differences and different thermal time constants between the electronics and the pump while taking into account the operating profile within the time constants.

The structural complexity for detecting the temperature of the fuel pump can be kept particularly low according to an advantageous development of the invention if the ohmic resistance of a phase of the electric motor of the fuel pump is used for determining the temperature of the fuel pump. The ohmic resistance varies with the temperature of the fuel pump. This is in particular the case if the current measurement is compared with a measurement made during the first initialization in a special operating mode of the electronics. Here the variation of the ohmic resistance of the phase can be determined particularly accurately if the current measurement is compared with an initial value. The initial value can be measured according to a special operating mode of the electronics during the first start-up.

The second-mentioned problem, namely the provision of a method for starting the fuel pump that ensures an adequate supply of fuel even at low temperatures, is solved according to the invention by the control electronics selecting a low temperature start program at an envisaged low temperature of the fuel and selecting a standard start program above the envisaged low temperature.

In this way the temperature of the fuel is taken into account in different start programs. This enables the start program to be configured for the viscosity of the fuel. The result of this is to ensure the supply of fuel even at low temperatures.

In general, the current level fed to the electric motor is limited in order to protect the electric motor and the control electronics. The protection is especially necessary at high temperatures. A reliable start-up of the fuel pump can be ensured according to another advantageous development of the invention with no risk of damaging the control electronics and the electric motor if a higher current level is selected for energizing the electric motor in the low temperature start program than in the standard start program. With the design the protection of the electric motor and the control electronics above the envisaged low temperature is adequately ensured. A further advantage of the high current level is that the fuel pump is heated particularly highly, which results in a reduction of the viscosity of the fuel.

In general, following the starting of the fuel pump an operating program for activating the electric motor is selected. However, in the case of a high viscosity of the fuel the fuel pump mainly requires a long period of time in order, for example, to reach the envisaged operating revolution rate and the envisaged rate of delivery. A too rapid changeover to the operating program can be simply avoided according to another advantageous development of the invention if the low temperature start program comprises a longer time duration than the standard start program.

The start-up behavior could, for example, be varied continuously with the temperature. However, diesel fuels tend to have an exponential rise of viscosity below a certain temperature. Therefore, the method is designed to operate the fuel pump particularly simply according to another advantageous development of the invention if a temperature threshold is specified as the envisaged low temperature and if a total of two temperature-dependent start-up programs can be selected. According to one definition, according to which the diesel fuel must still be transportable, this is the so-called CFPP (Cold Filter Plugging Point) temperature. The temperature threshold using which the start-up programs are selected is preferably slightly below the CFPP temperature.

The method for operating the fuel pump can be carried out particularly simply if the temperature of the control electronics disposed on the electric motor is measured. With the design, the temperature of the fuel can be concluded from the temperature of the control electronics. Therefore, according to the invention no further temperature sensor is necessary.

According to another advantageous development of the invention, if false starts of the fuel pump are detected and if the low temperature start-up program is selected regardless of the temperature of the fuel and for more than a number of false starts, this contributes to a further increase in the operating reliability of the fuel pump.

BRIEF DESCRIPTION OF THE DRAWINGS

The invention allows numerous embodiments. For a further explanation of its basic principle, one of the embodiments is represented in the figures and will be described below. In the figures.

DETAILED DESCRIPTION OF THE PRESENTLY PREFERRED EMBODIMENTS

Figure 1:
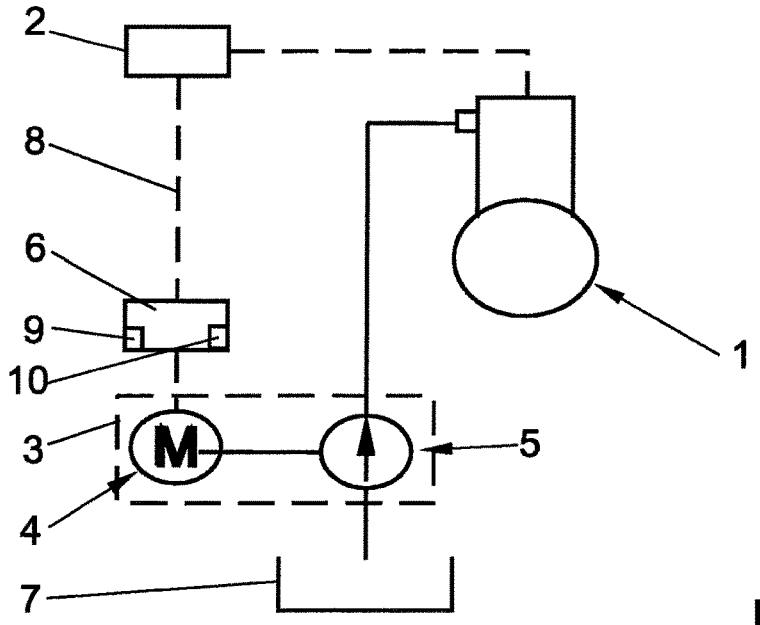
FIG. 1 shows a fuel pump for supplying an internal combustion engine.

FIG. 1 shows an internal combustion engine 1 with an engine controller 2 and with a fuel pump 3. The fuel pump 3 comprises a pump stage 5 activated by an electric motor 4 and control electronics 6 for activating the electric motor 4. The pump stage sucks fuel from a fuel tank 7 and delivers the fuel to the internal combustion engine 1. The control electronics 6 and the engine controller 2 comprise a data connection 8.

Furthermore, the control electronics 6 comprise a memory 9 for various programs and a temperature sensor 10. The fuel pump 3 carries a flow of fuel, so that the temperature sensor 10 of the control electronics 6 measures the temperature of the fuel.

Figure 2:
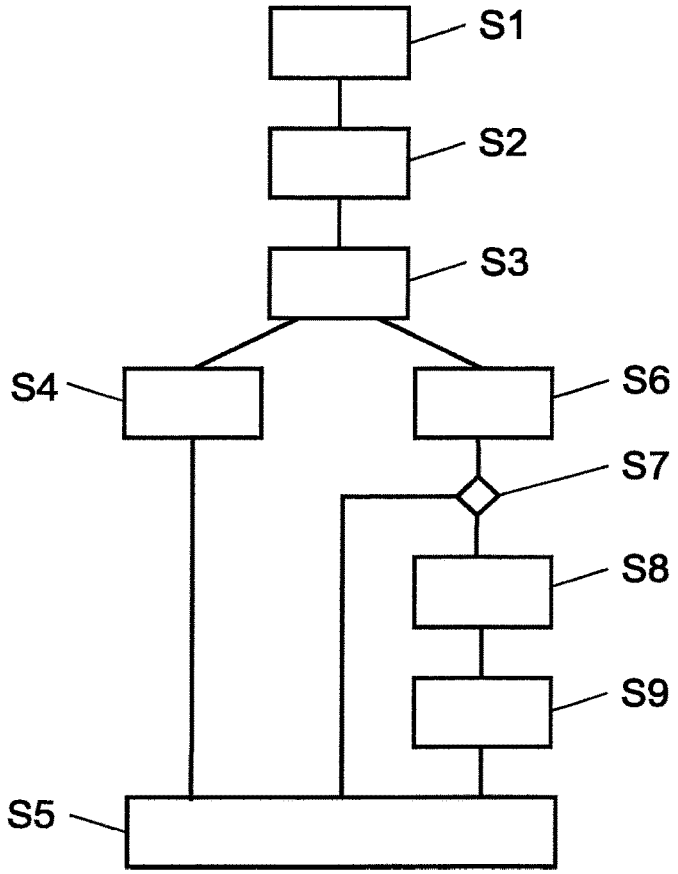
FIG. 2 shows schematically a method for starting the fuel pump.

FIG. 2 shows schematically a method for starting the fuel pump 3. In a first step S1, the start of the method is carried out with the desired start of the internal combustion engine 1. In the step S2, the temperature is measured by the temperature sensor 10. Depending on the temperature, in the step S3 a start program is selected from the memory 9 and is started. If the measured temperature is lower than a provided threshold value, a low temperature start-up program is started in the step S4.

Following execution of the low temperature start-up program, an operating program for operating the fuel pump 3 is started in the step S5. However, if the temperature is higher than the provided threshold value, a standard start program is started in the step S6. If control electronics 6 detect no false start in the step S7, the transition to the operating program takes place. If there are false starts of the fuel pump 3, the false starts are counted in the step S8 and, if the number of false starts exceeds an envisaged sum, the low temperature start program is started in the step S9. Then a change is made to the operating program.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A fuel pump (3) of a motor vehicle, comprising:

a pump stage (5) configured to induce fuel from a fuel tank (7), wherein the fuel is diesel fuel;

an electric motor (4) configured to drive the pump stage (5); and control electronics (6) configured to supply the electric motor (4) with electrical current, wherein the control electronics (6) includes a memory (9) storing a low temperature start program, a count of a number of false starts of the fuel pump determined by the control electronics (6), and a standard start program, the control electronics (6) being connected to a temperature sensor (10) and a selector configured to:

in a case in which the number of false starts of the fuel pump stored in the memory (9) is below a predetermined threshold, start the low temperature start program at an envisaged low temperature of the fuel, the envisaged low temperature being the Cold Filtering Plugging Point (CFPP) temperature, and select the standard start program above the envisaged temperature, and in a case in which the number of false starts of the fuel pump stored in the memory (9) indicates plural false starts at or above the predetermined threshold number of false starts, start the low temperature start program regardless of the temperature of the fuel, wherein control in accordance with the temperature sensor (10) is based at least in part on temperature differences and thermal time constant differences constants between the control electronics (6) and the fuel pump.

2. The fuel pump as claimed in claim 1, wherein the control electronics (6) comprises the temperature sensor (10).

3. The fuel pump as claimed in claim 1, wherein an ohmic resistance of a phase of the electric motor (4) is used to determine the temperature of the fuel pump (3).

4. A method for operating a fuel pump (3) of a motor vehicle, comprising:

supplying, by control electronics (6) having a memory (9), an electric motor (4) with electric current, the control electronics (6) being connected to a temperature sensor (10);

driving, by an electric motor (4), a pump stage (5) that sucks fuel from a fuel tank (7), wherein the fuel is diesel fuel;

detecting, by the control electronics (6), false starting of the fuel pump (3);

counting a number of false starts of the fuel pump occurring and storing the count in the memory (9);

selecting, by the control electronics (6), such that:

in a case in which the number of false starts of the fuel pump stored in the memory (9) is below a predetermined threshold, starting a low temperature start program at an envisaged low temperature of the fuel, the envisaged low temperature being the Cold Filtering Plugging Point (CFPP) temperature, and selecting a standard start program above the envisaged temperature, and in a case in which the number of false starts of the fuel pump stored in the memory (9) indicates plural false starts at or above the predetermined threshold of false starts, starting the low temperature start program regardless of the temperature of the fuel, wherein control in accordance with the temperature sensor (10) is based at least in part on temperature differences and thermal time constant differences constants between the control electronics (6) and the fuel pump.

5. The method as claimed in claim 4, wherein a higher current level for energizing the electric motor (4) is selected in the low temperature start program than in the standard start program.

6. The method as claimed in claim 4, wherein the low temperature start program has a longer time duration than the standard start program.

7. The method as claimed in claim 4, wherein a temperature threshold is specified as the envisaged low temperature and in total two temperature-dependent start programs are selectable.

8. The method as claimed in claim 4, wherein the control electronics (6) are disposed on the electric motor (4), the method further comprising measuring the temperature of the control electronics (6).

* * * * *